US006659828B1

(12) United States Patent
Seibold et al.

(10) Patent No.: US 6,659,828 B1
(45) Date of Patent: Dec. 9, 2003

(54) FLAT DISCHARGE LAMP AND METHOD FOR THE PRODUCTION THEREOF

(75) Inventors: Michael Seibold, Munich (DE); Michael Ilmer, Augsburg (DE); Angela Eberhardt, Augsburg (DE)

(73) Assignee: Patent-Treuhand-Gesellshaft fuer Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/673,082

(22) PCT Filed: Apr. 9, 1999

(86) PCT No.: PCT/DE99/01089

§ 371 (c)(1),
(2), (4) Date: Oct. 11, 2000

(87) PCT Pub. No.: WO99/54913

PCT Pub. Date: Oct. 28, 1999

(30) Foreign Application Priority Data

Apr. 20, 1998 (DE) ..... 198 17 478

(51) Int. Cl.[7] ..... H01J 9/26; H01J 9/32

(52) U.S. Cl. ..... 445/25; 445/24; 445/40; 313/495; 313/484

(58) Field of Search ..... 445/24, 25, 40; 313/484, 485, 493, 582

(56) References Cited

U.S. PATENT DOCUMENTS

| | | | | |
|---|---|---|---|---|
| 3,975,176 A | | 8/1976 | Salisbury | |
| 4,256,495 A | | 3/1981 | Kawamura et al. | |
| 5,346,863 A | | 9/1994 | Hikata et al. | |
| 5,461,279 A | | 10/1995 | Hasegawa | |
| 5,697,825 A | * | 12/1997 | Dynka et al. | 445/25 |
| 5,720,640 A | | 2/1998 | Lu et al. | |
| 5,733,828 A | | 3/1998 | Usui et al. | |
| 5,754,003 A | | 5/1998 | Murai et al. | |
| 5,820,435 A | * | 10/1998 | Cooper et al. | 445/25 |
| 5,827,102 A | * | 10/1998 | Watkins et al. | 445/25 |
| 6,030,267 A | * | 2/2000 | Browning | 445/25 |
| 6,036,567 A | * | 3/2000 | Watkins | 445/25 |
| 6,066,915 A | * | 5/2000 | Pepi | 313/495 |
| 6,129,603 A | * | 10/2000 | Sun et al. | 445/25 |

FOREIGN PATENT DOCUMENTS

| | | |
|---|---|---|
| DE | 197 11 892 | 9/1998 |
| EP | 0 324 953 | 7/1989 |
| EP | 0 363 832 B1 | 4/1990 |
| JP | 3-225743 | 10/1991 |
| JP | 7 335177 | 12/1995 |
| JP | 8-185802 | 7/1996 |
| WO | 81/01910 | 7/1981 |

* cited by examiner

*Primary Examiner*—Kenneth J. Ramsey
*Assistant Examiner*—German Colón
(74) *Attorney, Agent, or Firm*—Robert F. Clark

(57) ABSTRACT

The invention relates to a flat discharge lamp (1), comprising two substantially parallel plates (5, 6) and two support areas serving to support both plates against each other. Each support area consists of a component having a high-viscosity (8) and a low viscosity (7) at assembling temperature. Before assembling the discharge vessel, the support areas are larger than final distance envisaged between both plates. The low viscosity component (7) compensates for possible local deviations in the distance between both plates when the discharge vessel are assembled.

6 Claims, 2 Drawing Sheets

FLAT DISCHARGE LAMP AND METHOD FOR THE PRODUCTION THEREOF

TECHNICAL FIELD

The invention proceeds from a flat discharge lamp in accordance with the preamble of Claim 1. The invention also relates to a method in accordance with the preamble of the method claim for producing this discharge lamp.

The term "discharge lamp" in this case embraces sources of electromagnetic radiation based on gas discharges. The spectrum of the radiation can in this case comprise both the visible region and the UV (ultraviolet)/VUV (vacuum ultraviolet) region as well as the IR (infrared) region. A fluorescent layer can also be provided for the purpose of converting invisible radiation into visible radiation.

It is also a case here, in particular, of flat discharge lamps with so-called dielectrically impeded electrodes. Here, the dielectrically impeded electrodes are typically implemented in the form of thin metal strips which are arranged on the outer wall and/or inner wall of the discharge vessel. If all electrodes are arranged on the inner wall, at least some of the electrodes must be completely covered off from the interior of the discharge vessel with the aid of a dielectric layer. Discharge lamps of this type are disclosed, for example, in EP 0 363 832 (FIG. 3) and German Patent Application P 197 11 892.5 (FIGS. 3a, 3b). Flat discharge lamps—also denoted as flat radiators—have a discharge vessel which is formed from a base plate and cover plate, for example made from glass, which are interconnected via a frame.

It is possible to dispense with a frame when the base and/or cover part is not flat but formed such that a discharge vessel is already formed upon assembling only the base part and cover part. For example, the base part and/or the cover part can be shaped like a trough, for example by deep drawing. In this case, as well, for very large-area flat lamps the predominant fraction of the shaped base part and/or cover part is at least approximately flat and therefore requires one or more support points for stabilization.

Consequently, the terms base plate and cover plate are also to be understood below as structures which are actually, if appropriate, not completely but at least predominantly (approximately) flat.

The discharge vessel contains a gas filling of defined composition and filling pressure, and must therefore be evacuated before filling. Consequently, the discharge vessel must permanently withstand both underpressure specifically during the production of a lamp—and the later filling pressure, which is less than atmospheric pressure, for example between 10 kPa and 20 kPa. According to specification from glass manufacturers, this time-load withstand strength is to be set with a value of approximately 8 MPa and is yielded, as a function of the glass thickness used, from the maximum sag over a length between two supports. The latter is inversely proportional to the glass thickness used and at a specific temperature is, moreover, a function of the pressure difference between the interior of the discharge vessel and the outside.

Consequently, for a given pressure difference and temperature the time-load withstand strength can be achieved even in the case of thin glasses by shortening the length between two bearings. Use is made for this purpose of support points which are arranged over the base area of the discharge vessel adequately in terms of position and number. The mutual spacing between immediately adjacent support points is dimensioned such that the targeted length is not exceeded at any point.

PRIOR ART

The support points usually comprise a glass rod section, a glass ring, a glass tube or a glass ball whose heights, or respectively diameters correspond to the frame height. To date, the support points have been bonded to the base plate and/or cover plate by means of a suitable sintered glass. In this case, the bonding fixes only the support points, but is too thin to be able to compensate the differences in height.

Furthermore, recessed glass webs are also known. One possibility consists in processing a solid material by sandblasting such that the base plate is produced with an appropriate thickness and the glass webs are produced with the desired shape and height. In this case, as well, the cover glass and glass web are joined by bonding by means of a sintered glass.

A further possibility consists in integrating the webs by heat treatment of the glass such as, for example, deep-drawing by means of underpressure or dead weight or pressing. Here, the base plate or cover plate is heated above its softening point and shaped by means of a mould using standard methods.

SUMMARY OF THE INVENTION

It is the object of the present invention to provide a flat discharge lamp in accordance with the preamble of Claim 1 with improved support points.

This object is achieved by means of the features of Claim 1. Particularly advantageous refinements are to be found in the claims dependent thereon.

A further object consists in specifying an improved method for producing flat discharge lamps.

This object is achieved by means of the features of the method claim. Particularly advantageous refinements are to be found in the claims dependent thereon.

A precondition in the case of the considerations set forth at the beginning for stabilizing the discharge vessel by means of support points is that adequate, double-sided contact is ensured with the base plate and cover plate for all support points. Specifically, if a support point does not have two-sided contact, it fails as an effective support. Consequently, the free length in the region of this ineffective support point is doubled, viewed radially starting from the latter and in the plane of the plates. The targeted length is therefore exceeded in some circumstances and the time-load withstand strength is impermissibly reduced. It is necessary for this reason, also to take account of and even out irregularities in the base plate and cover plate over the basic area of the discharge space, as well as frame height tolerances. This gives rise to increased difficulties, particularly in the case of a rising number of support points and an increasing area.

The invention proposes support points which each comprise two components. These two components are distinguished in that they have clearly differing viscosities during joining of the vessel, that is to say at the jointing temperature. Here, one component works as a so-called "hard part" and has a very high viscosity, typically more than $10^9$ dPa s, preferably $10^{11}$ dPa s and higher at the jointing temperature. A soda-lime-silica glass is suitable, for example. The other component works as a so-called "soft part" with a low viscosity, tuned to the jointing temperature, in the region of typically $10^3$ dPa s to approximately $10^5$ dPa s or less, that is to say a defined and nondestructive deformation is provided precisely at the jointing temperature, possibly with a slight application of force. Sintered glass or lead glass, for example, is suitable.

In principle, virtually any shapes are initially conceivable for the "hard" part, in particular including bar sections, tube sections, tubes, balls, rings, bars and the like. In principle, virtually any shapes are likewise suitable for the "soft" part, for example rings, pieces of a cylinder, truncated cones, platelets or troughs. However, in each case the shapes of the two components are to be suitably coordinated with one another. The viscosities of such sintered glass parts are produced by tuned mixing ratios of different sintered glasses, using standard methods such as, for example, pressing, casting, extruding and subsequent sintering. The possibility exists here of producing these sintered parts immediately with the desired dimensions, or of fabricating them by machining ahead of the sintering. Moreover, the two components can also respectively be connected from the start to form a single-piece support point.

The mode of operation of a two-component support point during production of a flat discharge lamp consists in that its height before joining of the lamp deliberately exceeds the height of the frame, for example, in the range from a tenth of a millimetre to a few millimetres, in particular between approximately 0.5 mm and 2 mm. The cover part therefore bears only against the support points before the joining operation. When the jointing temperature is reached, the "soft" part of the support points in each case attains a sufficiently low viscosity, typically of the order of magnitude of $10^7$ dPa s, to be deformed under the weight of the cover plate. The cover plate sinks in this case onto the frame, coated with solder, for example glass solder, and fuses together with the latter. The lamp is sealed in this way.

The great advantage of this mode of procedure is as follows. Since the cover plate always bears against all support points in this operation, each support point is levelled to the required height, that is to say exactly such that each support point makes double-sided contact with the base plate and cover plate.

In addition, this property of the two-component support point permits the lamp to be produced without an exhaust tube in a vacuum furnace filled with filling gas at filling pressure, since the lamp closes automatically as the jointing temperature is reached.

In the extreme case, the support points can also respectively comprise to a decidedly predominant extent a component of low viscosity and a separating layer of high viscosity as second component which prevents the component of low viscosity from sintering onto the base plate or cover plate. Fluorescent material can also serve as separating means.

DESCRIPTION OF THE DRAWINGS

The invention is to be explained in more detail with the aid of a plurality of exemplary embodiments. In the drawing:

FIGS. 1*a* and 1*b* respectively show a schematic partial section through a flat discharge lamp 1 before the discharge vessel 2 is hermetically sealed, and in the finished state.

Figure 1A:
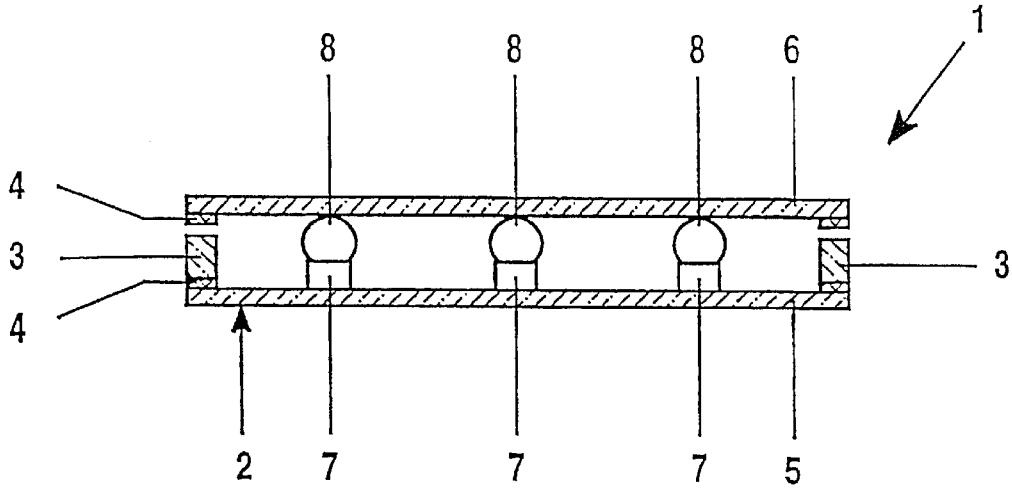
FIG. 1*a* shows a partial section through a flat discharge lamp before the discharge vessel is hermetically sealed.
Figure 1B:
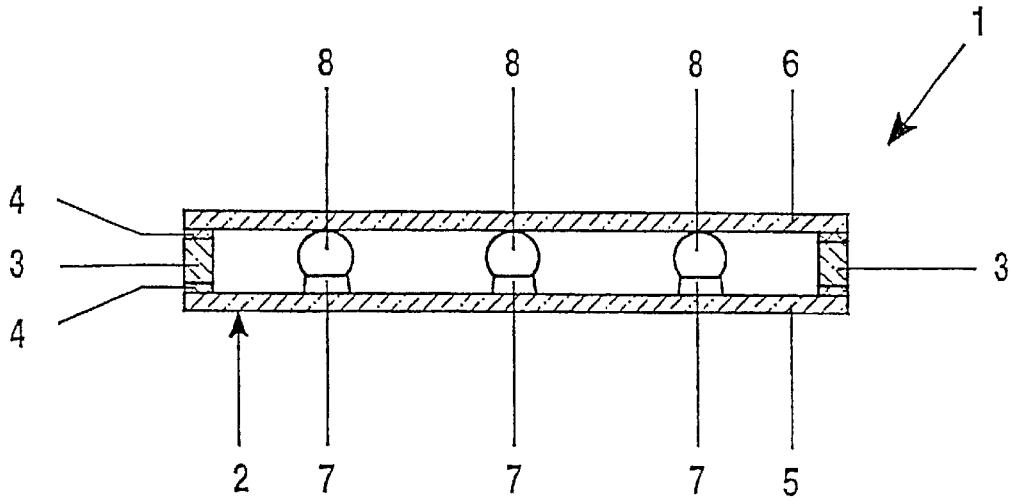
FIG. 1*b* shows a partial section through a finished flat discharge lamp.

Firstly, the electrodes are usually applied to the base plate and/or cover plate, for example by means of a printing method, possibly with the addition of dielectric layers, fluorescent layers etc., but this is not illustrated, for the sake of clarity. The person skilled in the art is conversant in any case with the method steps for implementing these features.

In a following step, a circumferential frame 3 is applied to the base plate 5 by means of glass solder 4. The height of the frame 3 above the inner wall of the base plate 5 is approximately 5 mm. A circumferential glass solder track 4 is likewise applied to the cover plate 6. The frame, base plate and cover plate consist of soda-lime-silica glass. During the later joining of the individual parts, the glass solder 4 serves the purpose of fusing the base plate 5 and cover plate 6 together with the frame 3, and sealing them.

Thereafter, pieces 7 of a circular cylinder which are made from alkali lead glass (a content of 40% by weight of PbO) are arranged on edge at the desired mutual spacing on the base plate 5. Subsequently, a glass ball 8 made from soda-lime-silica glass is mounted on each piece 7 of a circular cylinder. The pieces 7 of a circular cylinder have the following dimensions: height=1.8 mm, outside diameter=4 mm and inside diameter=2.8 mm. The diameter of the glass balls 8 is approximately 5 mm. Consequently, before the joining process the respective overall height of the two-part support points 7, 8 above the base plate 5 is greater than the corresponding height of the frame, specifically by approximately 1 mm.

The cover plate 6 is now mounted on the balls 8, and the overall arrangement of base plate 5, frame 3 with glass solder 4, two-part support points 7, 8 and cover plate 6 is placed in an evacuable furnace (not illustrated).

Thereafter, the furnace is evacuated at a temperature of approximately 350° C. for about 30 minutes, in order largely to remove impurities. Since the pieces 7 of a circular cylinder are not yet of sufficiently low viscosity at the temperature of approximately 350° C., the cover plate 6 and the frame 3 are not yet joined during this fabrication step.

Upon termination of the baking and evacuation, the furnace and, since the discharge vessel 2 is still open, consequently also the interior between the base plate 5 and cover plate 6 is filled with filling gas, here xenon.

The temperature in the furnace is subsequently increased to approximately 520° C. In this process, the pieces 7 of a circular cylinder achieve a viscosity which is so low, of the order of magnitude of approximately $10^6$ dPa s, that the cover plate 6 sinks onto the frame 3. The glass solder 4 likewise achieves a viscosity which is so low, of the order of magnitude of approximately $10^5$ dPa s, that it joins the base plate 5 and the cover plate 6 to the frame 3 to form the gas-tight discharge vessel 2. During the sinking of the cover plate 6, the individual support points 7, 8 are levelled to the exact height required in such a way that each support point 7, 8 makes double-sided contact with the base plate 5 and cover plate 6. The viscosity of the base plate and cover plate, frame and glass balls is more than $10^9$ dPa s at the jointing temperature of 520° C.

Figure 2:
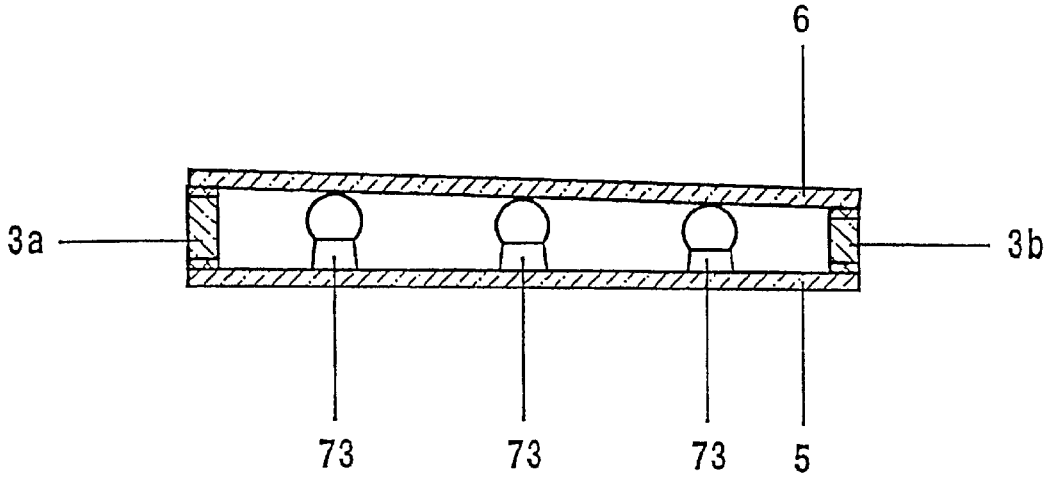
FIG. 2 shows a partial section through a further flat discharge lamp for the purpose of explaining the height-equalizing effect of the two-component support points.

The advantageous effect of the automatic leveling of the two-component support points 7, 8 is conspicuous, in particular, in FIG. 2, which shows a schematic partial section through a flat lamp 1' with a cover plate 6 which is oblique with respect to the base plate 5. This oblique position is caused by the fact that the left-hand part 3*a* of the frame is higher than the right-hand part 3*b*. This undesired oblique position is drawn greatly overemphasized for the purpose of illustration. Similar oblique positions can also be caused by locally fluctuating thicknesses of the plates and/or inadequate planarity of the plates or the like. It is clearly to be seen in FIG. 2 that the heights of the pieces 73 of a circular cylinder increase from right to left, and in this way even out the different spacings between the base plate 5 and the cover plate 6.

In a variant (not illustrated), in each case the first component comprises a tube made from soda-lime-silica glass, and the second component comprises a trough made from lead glass. In each case, a tube is partially embedded in a trough, and thereby forms a support point which extends along a side of the base plate in a fashion parallel to a side of the frame. This variant has the advantage that these support points made from tube and trough support the plates in a quasi-linear fashion instead of in a punctiform fashion, as above. This can be advantageous, in particular, to lamps of a very large area, since there is then a need for relatively few tubes with troughs instead of very many balls with rings.

Depending on requirement, it is optionally possible to interpose yet further method steps on the lamp, for example for the purpose of applying a fluorescent layer and/or reflecting layer inter alia.

Moreover, the lamp can also be provided with an exhaust tube for evacuating or filling the assembled discharge vessel. It is possible in this case to dispense with an evacuable and fillable furnace. The method of fabrication is then modified in such a way that a discharge vessel is firstly assembled in the furnace as described above and provided with an exhaust tube. Subsequently, the discharge vessel is evacuated via the exhaust tube and simultaneously baked in the furnace. Thereafter, the discharge vessel is filled with the filling gas via the exhaust tube and finally sealed. The lamp is thereby finished.

What is claimed is:

1. Method for producing a flat discharge lamp having a discharge vessel which discharge vessel has a cover plate and a base plate, support points between the cover plate and base plate, which support points in each case comprise two components of different viscosity, the viscosity of the first component being lower at a jointing temperature than the viscosity of the second component, electrodes which are arranged on the discharge vessel wall, and having the following method steps:

(a) applying a hermetically sealing means to the base plate and/or cover plate;

(b) arranging the two component support points on the base plate, the dimensions of the support points perpendicular to the plane of the cover plate or base plate initially being larger than the final spacing provided between the base plate and cover plate, the first components comprising rings or pieces of a right circular cylinder and the second components comprising balls;

(c) mounting the cover plate on the base plate with the aid of the support points;

(d) inserting the base plate with support points, sealing means and cover plate into an evacuable furnace;

(e) evacuating and heating the furnace to remove gaseous impurities, the temperature inside the furnace being only so high that the first components of the support points are still sufficiently viscous to prevent sinking of the cover plate;

(f) filling the furnace with a filling gas to a filling pressure; and (g) heating the furnace to the jointing temperature, at which the first components of the support points become of sufficiently low viscosity such that the cover plate finally sinks to the final spacing provided between the cover plate and base plate, the sealing means simultaneously at least partially attaining a sufficiently low viscosity as to join the cover plate and base plate together.

2. Method according to claim 1, in which the sealing means comprises a frame which is provided on its underside and/or top side with a glass solder, which glass solder attains at the jointing temperature a viscosity sufficiently low to ensure a connection and, after cooling, a hermetic seal between the base plate and frame, on the one hand, and between the frame and cover plate, on the other hand.

3. Method according to claim 1, in which when the two-component support points are being arranged the rings or pieces of a circular cylinder are firstly arranged on the base plate, and subsequently a ball is respectively mounted on each ring or on each piece of a circular cylinder.

4. Method according to claim 3, in which the inside diameter of the rings or pieces of a circular cylinder are smaller than the diameters of the balls in such a way that the balls are fixed in the rings or pieces of a circular cylinder.

5. Method according to claim 1, in which the second components consist of glass.

6. Method according to claim 1, in which the first components consist of a sintered glass selected from Pb—B—Si—O, Bi—B—Si—O, and Pb—Bi—(Zn)—B—Si—O, the Zn component being optional.

* * * * *